US007434693B2

(12) United States Patent
Mosko

(10) Patent No.: US 7,434,693 B2
(45) Date of Patent: Oct. 14, 2008

(54) MARINE KNIFE BLOCK FOR MOUNTING ON BOATS AND MARINE VESSELS

(76) Inventor: John George Mosko, Hibiscus House, Lyford Cay, Nassau (BS)

( * ) Notice: Subject to any disclaimer, the term of this patent is extended or adjusted under 35 U.S.C. 154(b) by 110 days.

(21) Appl. No.: 10/835,243

(22) Filed: Apr. 29, 2004

(65) Prior Publication Data

US 2005/0241984 A1 Nov. 3, 2005

(51) Int. Cl.
*A47J 23/00* (2006.01)
*B65D 6/04* (2006.01)

(52) U.S. Cl. ..... 206/553; 99/485; 211/70; 211/70.7; 248/37.3; D7/637

(58) Field of Classification Search ..... 206/349, 206/553, 223, 372–373; 211/70.7; 248/37.3; D7/637

See application file for complete search history.

(56) References Cited

U.S. PATENT DOCUMENTS 4,423,552 A * 1/1984 Bourgein et al. ..... 30/298.4
4,497,129 A 2/1985 Chestnut
D280,587 S * 9/1985 Carlson ..... D7/637
4,541,539 A 9/1985 Matthews
4,561,548 A * 12/1985 Call ..... 211/70.7
4,866,845 A 9/1989 McEvily
4,871,099 A 10/1989 Bogar, Jr.
5,245,756 A 9/1993 Howell et al.
5,363,957 A 11/1994 Reichner
5,522,765 A 6/1996 Dotson et al.
5,655,672 A 8/1997 Stuchlik
5,850,784 A * 12/1998 Conner ..... 99/485
6,058,609 A * 5/2000 Yen et al. ..... 30/298.4
6,079,108 A * 6/2000 Lin ..... 30/298.4
6,328,360 B1 * 12/2001 Freeman ..... 294/1.1

* cited by examiner

*Primary Examiner*—Jila M Mohandesi
(74) *Attorney, Agent, or Firm*—CBER/KALER; Royal W. Craig

(57) ABSTRACT

A marine knife block for mounting on boats and marine vessels. The block is formed from three or more uniform blanks of plastic resin with channels milled or molded lengthwise into two or more of those layers. The three layers are sandwiched together by a combination of stainless steel screws and glue to form a plurality of knife blade receptacles. The back of the block may be secured to a flat surface by screws, thereby preventing movement of the knives held within when the boat is in motion.

10 Claims, 4 Drawing Sheets

MARINE KNIFE BLOCK FOR MOUNTING ON BOATS AND MARINE VESSELS

BACKGROUND OF THE INVENTION

1. Field of the Invention

The present invention relates generally to a block for storing knives, and more particularly, to a marine knife block for mounting on boats and marine vessels.

2. Description of the Background

There are a variety of commercially-available knife blocks, virtually all having a plurality of slots to store a plurality of knives. For example, standard kitchen knife blocks have a pleasing appearance and are designed to be used in the kitchen and placed on a counter top so that the knives will be easily accessible when needed. These devices are typically manufactured from a solid block of wood or plywood, the slots being machined therein, and they are free-standing (it is not necessary to anchor the knife block in place). U.S. Pat. No. 4,866,845 to McEvily shows such as block with an integral sharpener for holding, storing and sharpening knives. The block includes a body having a plurality of elongated housing members disposed within. Each housing member includes an open end and defines a cavity within the body member for receiving a knife blade through the open end. Sharpeners are disposed within each cavity. Such free-standing knife blocks are ill-suited for marine environments. If used aboard boats or other marine vessels, these blocks pose a safety concern because they can move about when the boat is in motion, and the knives stored in the blocks can easily fall out of their holder and cause bodily harm. Moreover, the salt environment eventually dissolves any glue used to bond the plywood, destroying the block over time.

There have been a few attempts to overcome these problems. For example, U.S. Pat. No. 5,245,756 to Howell et al. shows a lockable knife and block assembly with a plurality of slots for housing a plurality of knife blades. Each knife blade has a notch for engaging a spring-loaded lock located at the top and front of each slot. A push button release mechanism is attached to each lock for disengaging a knife blade latched thereto.

U.S. Pat. No. 5,655,672 to Stuchlik shows a slidable knife holder including a knife holding block with a plurality of slots for holding a plurality of knives, and a slidable mount so that the block is slidably mountable to a support structure, so that the block moves between a retracted position and an extended position.

Moreover, there are a few specially-adapted marine knife holders. However, these devices are typically multi-purpose devices of which holding a single knife is simply one of the multiple features.

An example of such a device is U.S. Pat. No. 5,363,957 to Reichner which shows a marine tool holder that slides over a tool (such as a knife) protecting it from water and other rust inducing conditions. The tool holder comprises a cover having an internal cavity that holds two retainer sections of polyethylene. The inside face of each retainer section has an abrasive surface that automatically scrubs the exterior surface of the tool while it is being inserted and removed from the holder.

U.S. Pat. No. 5,522,765 to Dotson et al. shows a fish cleaning board with a work surface, and a knife slot to keep a knife in a convenient location for use. The board also includes a knife holder to store the knife during transportation and storage.

U.S. Pat. No. 4,497,129 to Chestnut shows a fishing rod holder made of an integrally molded plastic with integral bait box, cutting board and a slot for a bait knife.

U.S. Pat. No. 4,541,539 to Matthews shows composite compartmented cooler for both bait and catch as well as for drinks, food and the like. A cutting board area with built-in knife holder is also provided.

U.S. Pat. No. 4,871,099 to Bogar, Jr. shows a fishing rod holder with horizontally spaced supports that receive the blade of a knife.

The primary feature and objective of these prior devices designed for marine use is not knife storage, but storage of fishing gear or other fishing related equipment, and as such they are designed to hold merely one knife. The prior devices that are not designed for marine use may hold a plurality of knives, but they are not designed to withstand the rugged salt environment, nor do they secure the knives from moving about while the vessel is in motion.

It would be greatly advantageous to provide a rugged yet economical knife holder for use on boats that withstands the sea environment, holds a plurality of knives, and can be securely fastened to a wall, cabinet or other vertical surface, allowing the knives to be easily accessible, yet preventing movement and potential dangerous consequences when the boat is in motion.

SUMMARY OF THE INVENTION

It is, therefore, an object of the present invention to provide a knife holding block for storing a plurality of knives and for mounting said block on boats and marine vessels.

It is another object to provide a design for a knife holding block which lends itself to economical manufacture from uniform sandwiched layers of plastic resin, said layers forming a plurality of knife blade receptacles.

It is another object to provide a knife block as described above that is safe, sturdy and long-lived in a marine environment.

According to the present invention, the above-described and other objects are accomplished by providing a knife holding block for storing a plurality of knives and for mounting said block on boats and marine vessels. Said block is formed from three or more layers of plastic resin with channels milled lengthwise in two or more of those layers. The multiple layers are sandwiched together to form a plurality of blade receptacles. The knife holding block holds a plurality of knives immobile until they are needed, at which time they are easily accessible. Moreover, it is formed of sandwiched layers of plastic to withstand the rugged environment of the sea yet keep it economical to manufacture. The knife holding block can be mounted to a vertical or horizontal surface to maintain the knives in a stationary position while the vessel is in motion.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
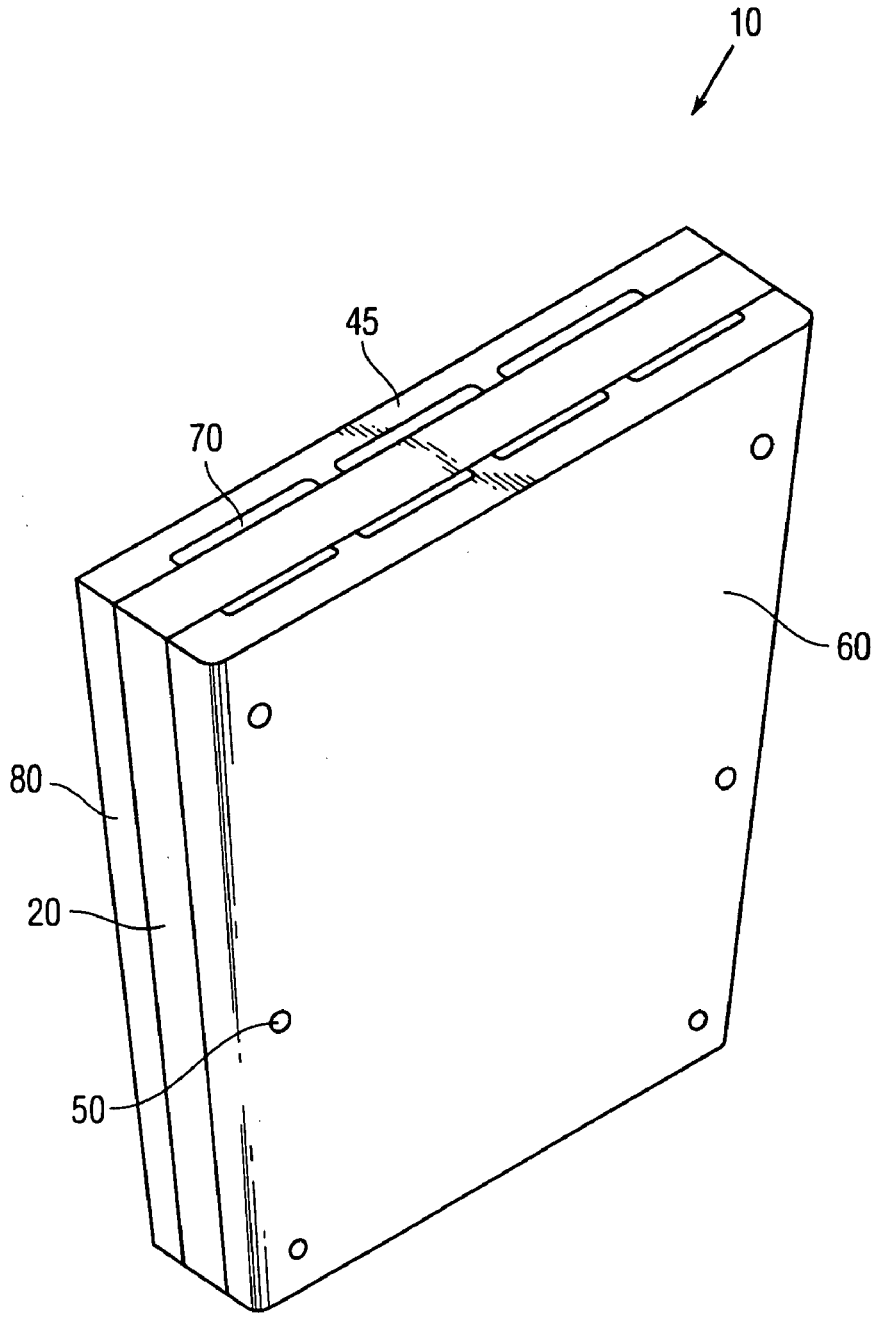
FIG. 1 is a front isometric view of a marine knife block 10 according to a preferred embodiment of the present invention.
Figure 2:
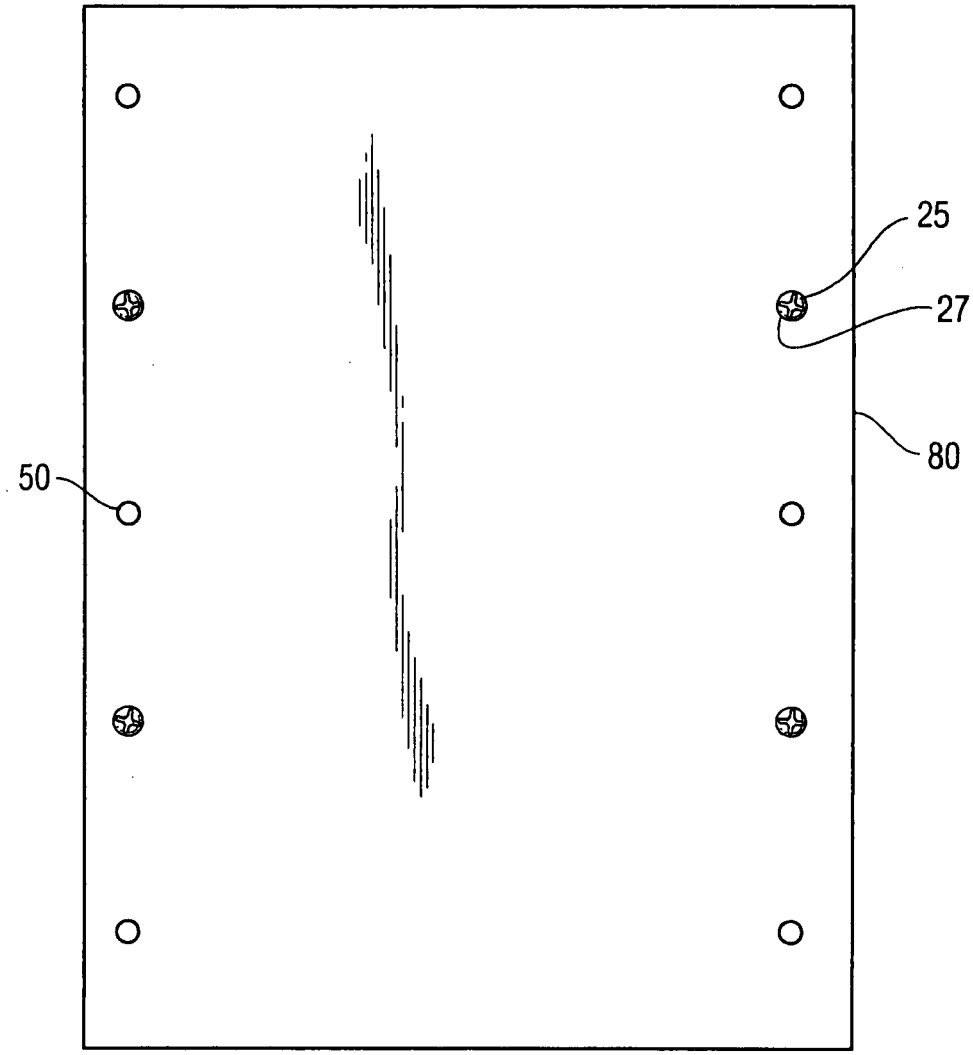
FIG. 2 is a rear view of the marine knife block 10 of FIG. 1.
Figure 3:
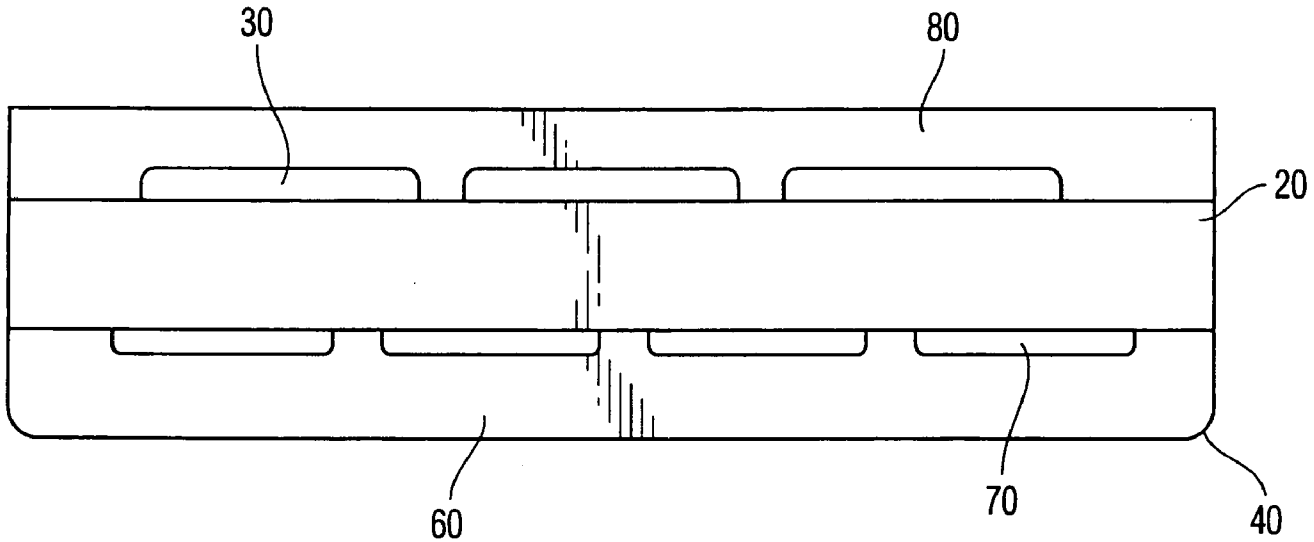
FIG. 3 is a top view of the marine knife block 10 of FIGS. 1 and 2.

FIGS. 1-3 are, respectively, front isometric, rear perspective, and top perspective views of a marine knife block 10 according to a preferred, three-layer embodiment of the present invention. It should be noted that the design concept lends itself to other embodiments with more than three layers, the number of layers being a matter of design choice depending on the number of knife receptacles that are desired. The marine knife block 10 provides a secured storage device for safely holding a plurality of knives (not shown in the Figures). The block 10 may be used anywhere, but it is particularly well-suited for use on boats and marine vessels where the movement of the boat/vessel may cause unsecured devices (i.e. knives) to move about and potentially cause bodily harm. On a boat/vessel, the block 10 may be secured to a vertical surface such as a wall, or to a horizontal surface such as a table or counter top.

The stationary and secured marine knife block 10 allows knives to be readily accessible when needed, yet be safely held in place when not in use. The marine knife block 10 is formed of sandwiched layers 20, 60, 80 of plastic resin to withstand severe impacts as well as the harsh environmental conditions and salt air of the sea. The plastic resin layers 20, 60, 80 are sandwiched together and fastened by a combination of glue and screws in a durable yet lightweight and economical configuration. The resulting knife block 10 is safe, secure, rugged, and economical to manufacture, and it stores a plurality of knives of different sizes and shapes.

Figure 4:
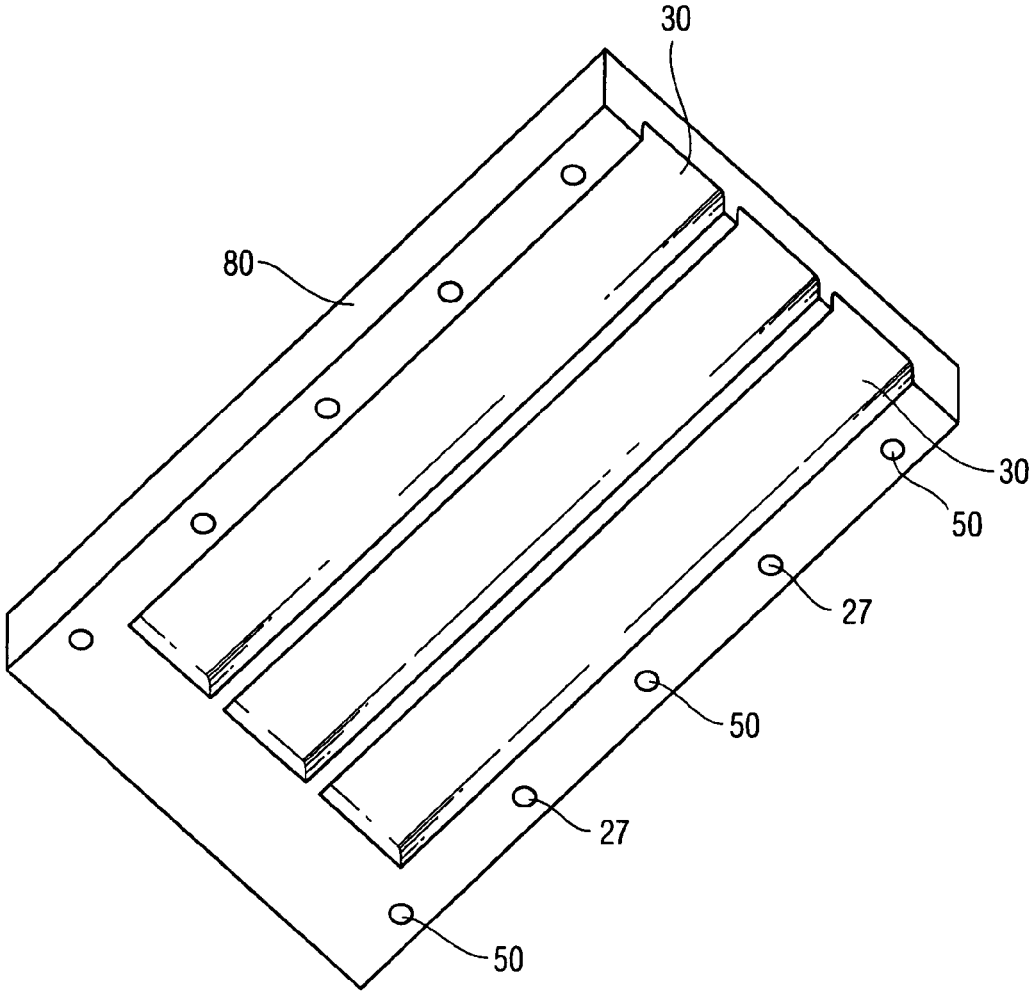
FIG. 4 is a front perspective view of a layer 80 of the marine knife block 10 of FIGS. 1-3.

As seen in FIGS. 1 and 3, the marine knife holder 10 is preferably formed from three layers 20, 60, 80 of plastic resin, such as a propylene polymer. FIG. 4's front perspective view of one of the layers 80 shows a plurality of channels 30 milled lengthwise into one of its surfaces. When the three layers 20, 60, 80 are sandwiched together, a plurality of blade receptacles 70 are formed. The layers 20, 60, 80 are typically held together by a plurality of stainless steel screws 25 that extend through clearance holes in layers 20 and 80 before engaging threaded holes (obscured in FIGS. 1 and 3) formed in layer 60. The outer corners 40 of layer 60 are rounded to prevent injury.

The marine knife holder 10 is formed with a substantially rectangular configuration (i.e. its length and width are unequal, but joined at 90° angles) and a depth of several inches. The openings for the blade receptacles 70 are on the top 45 of the marine knife holder 10 typically formed in two parallel rows. The blade receptacles 70 are preferably equidistant from each other. The dimensions of the receptacles 70 may vary (as a matter of design choice) to accommodate multiple sizes and/or types of knives. A plurality of clearance holes 50 extend through each of the layers 20, 60, 80 to provide for the secure mounting, via the use of a plurality of stainless screws, of the block 10 to a wall or other flat surface. An alternative to securing the block 10 to a surface is to place, or stand, it upright on a table, cabinet, or counter top.

Each layer 20, 60, 80 of the marine knife block 10 is formed from substantially uniform (i.e. length, width, thickness) polypropylene blanks. A plurality of channels 30 are milled lengthwise along a surface of some of the blanks in a specified array of widths and depths to accommodate various knife blade shapes/sizes. The use of uniform blanks greatly reduces the manufacturing cost, while the layered construction greatly increases the strength of the knife block 10. An alternative method of manufacturing the layers 60, 80 with channels 30 is via injection molding.

Typically, there are no channels milled into the central layer 20 of the block 10, it is left substantially intact with no milling or rounding of its corners, i.e. the central layer 20 has entirely planar opposing faces. Each channel 30 begins at one end of a layer 60, 80 (see FIG. 4), but terminates approximately 1" short of the layer's other end. The multiple layers 20, 60, 80 of the marine knife holder 10 are then secured together in a sandwiched configuration. The channels 30 in the outer layers 60, 80 thereby being closed off by the unmilled surfaces of the central layer 20, thereby defining a specified array of knife receptacles of various widths and depths.

In addition to the stainless steel screws 25, the layers 20, 60, 80 may also be glued together for maximum durability. A superior bond is achieved by first applying a polyolefin surface primer, and then using a cyanoacrylate adhesive bonding agent such as that commercially available from Loctite Corporation. The bonded layers 20, 60, 80 are then secured by stainless steel screws 25 which resist corrosion in the marine environment.

FIG. 3 is a top view of the marine knife block 10 showing the three layers of plastic resin 20, 60, 80 and the milled channels 30 sandwiched together to form a plurality of knife receptacles 70. FIG. 2 is a rear view of the block 10 showing that, in contrast to the rounded corners 40 on the front of layer 60, the corners at the back of layer 80 are left sharp/straight to conform to the flat surface on which the block is mounted. Clearance holes 50 are spaced along the sides of the layers 20, 60, 80 to receive the screws (not shown in the Figures) that mount said block 10 to a wall, counter top, or other flat surface. Once mounted, the block 10 becomes stationary and the knives are secured from moving about when the boat is in motion.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A marine knife block for mounting on a support structure to hold knives safely and securely, comprising:

three substantially rectangular layers of plastic resin all formed with substantially uniform length, width, and thickness, and all being attached together face-to-face in a sandwiched configuration, further including, a first outer layer formed with a plurality of lengthwise channels running from top to near-bottom along an inner face thereof, an opposing planar face mounted to said support structure, and a plurality of clearance holes penetrating from said inner face through said opposing planar face;

a central layer having entirely planar opposing faces, one of said planar faces being fixedly attached to the inner face of said first outer layer and bounding said lengthwise channels to define a first plurality of knife blade receptacles, said central layer being formed with a plurality of clearance holes penetrating from said one planar face through said opposing planar face; and a second outer layer formed with a plurality of lengthwise channels running from top to near-bottom along an inner face thereof said inner face of the second outer layer being fixedly attached to said opposing planar face of said central layer and bounding said lengthwise channels to define a second plurality of knife blade receptacles, said second outer layer also having an opposing planar face formed with rounded corners thereabout to prevent injury, and a plurality of clearance holes penetrating from said inner face through said opposing planar face;

a plurality of screws secured through said plurality of clearance holes in said first outer, central, and second outer layers to bind them together in said sandwiched configuration.

2. The marine knife block according to claim 1, wherein said plurality of screws comprise stainless steel screws.

3. The marine knife block according to claim 2, wherein said three substantially rectangular uniform layers of plastic are secured together in a sandwiched configuration by a combination of said stainless steel screws and glue applied between said layers.

4. The marine knife block according to claim 1, wherein said three substantially rectangular uniform layers of plastic resin are formed of polypropylene.

5. A marine knife block for holding knives securely, comprising:

a first outer layer formed with a plurality of lengthwise channels running from top to near-bottom along a face thereof, an opposing face having sharp corners, whereby said opposing face is mounted to a flat surface, a plurality of first clearance holes, and a plurality of second clearance holes penetrating from said face through said opposing face;

a central layer having an entirely planar face fixedly attached to said opposing face of said first layer and bounding said lengthwise channels to form a plurality of first knife receptacles, said central layer formed with a plurality of first clearance holes and a plurality of second clearance holes penetrating from said face through an entirely planar opposing face; and a second outer layer formed with a plurality of lengthwise channels running from top to near-bottom along a face thereof, said face of the second outer layer being fixedly attached to said entirely planar opposing face of said central layer and bounding said lengthwise channels to form a second plurality of knife receptacles, an opposing face having rounded corners to prevent injury, and a plurality of clearance holes, and a plurality of threaded holes penetrating from said face through said opposing face;

wherein said layers are substantially uniform rectangular layers, further wherein said plurality of first clearance holes in said first outer layer, said plurality of first clearance holes in said central layer, and said plurality of clearance holes in said second outer layer are aligned, thereby allowing said marine knife block to be securely mounted to said flat surface by a plurality of screws passing through said plurality of first clearance holes in said first outer layer, said plurality of first clearance holes in said central layer, and said plurality of clearance holes in said second outer layer.

6. The marine knife block according to claim 5 wherein said first outer, central, and second outer layers are held together by glue.

7. The marine knife block according to claim 5, wherein said plurality of second clearance holes in said first outer layer, said plurality of second clearance holes in said central layer, and said plurality of threaded holes in said second outer layer are aligned, and said first outer, central, and second outer layers are held together by a plurality of screws passing through said plurality of second clearance holes in said first outer layer and said plurality of second clearance holes in said central layer before engaging said plurality of threaded holes in said second outer layer.

8. The marine block according to claim 7, wherein said plurality of screws are fabricated of stainless steel.

9. The marine knife block according to claim 5 wherein said first outer, central, and second outer layers are fabricated of a plastic resin.

10. The marine block according to claim 9, wherein said plastic resin is a propylene polymer.

* * * * *